United States Patent [19]

Tsui

[11] 4,295,036

[45] Oct. 13, 1981

[54] TOY CASH REGISTER

[75] Inventor: Kwok W. Tsui, Wanchai, Hong Kong

[73] Assignee: Arco Industries Ltd., Hong Kong

[21] Appl. No.: 143,850

[22] Filed: Apr. 25, 1980

[51] Int. Cl.[3] ..... G07G 1/00

[52] U.S. Cl. ..... 235/1 E; 46/2

[58] Field of Search ..... 235/1 E, 9, 12, 22, 235/23; 46/2

[56] References Cited

U.S. PATENT DOCUMENTS

| | | | |
|---|---|---|---|
| 1,198,825 | 9/1916 | Chein | 235/12 |
| 1,227,054 | 5/1917 | Jacobs | 235/12 |
| 2,458,850 | 1/1949 | Hardick | 235/12 |
| 3,045,902 | 7/1962 | Thomson | 235/12 |
| 3,401,878 | 9/1968 | Cushman et al. | 235/9 |
| 3,497,991 | 3/1970 | Lewis | 46/2 |
| 4,164,319 | 8/1979 | Wallach | 235/1 E |

*Primary Examiner*—L. T. Hix
*Assistant Examiner*—Thomas H. Tarcza
*Attorney, Agent, or Firm*—C. Hercus Just

[57] ABSTRACT

A toy cash register principally molded from rigid plastic material and comprising a shell-like housing having an upstanding rearward portion containing a rotatable register drum having cash indicia thereon, a drawer slidable in the lower portion of said housing, a unitary cash key-simulating member mounted within an opening in a surface sloping downwardly and forwardly from said upstanding portion and depressible to actuate said register drum, a drawer release key pivoted at one side of said housing to release a latch for said drawer, and said drawer also projecting a receipt-simulating slide when moved to open position.

10 Claims, 5 Drawing Figures

TOY CASH REGISTER

BACKGROUND OF THE INVENTION

This invention pertains to a toy cash register and primarily is assembled from parts molded from rigid plastic material to facilitate manufacturing, as well as assembling, and thereby minimizing the cost of production.

Toy cash registers of many types have been developed heretofore. The earlier ones primarily were formed from metal and in view of the fact that the cash recording was effected by vertical slidable members in full scale cash register, the toys which simulated the same also had vertically slidable recording blades. Typical examples of this type of cash register are found in prior U.S. Pat. Nos. 1,198,825 to Chein, dated Sept. 19, 1916, and 2,458,850 to Hardick, dated Jan. 11, 1949. Said cash registers also were provided with drawers slidable in the lower portion thereof similar to full scale commercial type cash registers and cas-indicating levers were pivotally mounted to effect actuation of the sale-indicating slide.' Another similar cash register of this type is found in prior U.S. Pat. No. 3,045,902 to Thomson, dated July 24, 1962.

Another early type of toy cash register included a rotating cylinder to display amounts of cash and included a cash drawer and an example of the same is found in prior U.S. Pat. No. 1,227,054 to Jacobs, dated May 22, 1917.

In view of the fact that many modern types of cash registers employ a bank of keys which are pushed to indicate the amount of a certain sale, toy cash registers have also been developed to simulate this type of operation and one typical example thereof is found in prior U.S. Pat. No. 4,164,319 to Wallach, dated Aug. 14, 1979. This patent also discloses a paper tape simulating a cash receipt. While not directly related to toy cash registers, prior U.S. Pat. No. 3,401,878 to Cushman et al, dated Sept. 17, 1968, discloses a calculating machine in which a bank of actuating keys are employed to effect a total on a rotating drum viewable through openings, the recording being effected by rotating a crank.

Still another toy cash register having a rotatable register drum is found in prior U.S. Pat. No. 3,497,991 to Lewis, dated Mar. 3, 1970.

Primarily to minimize the cost of a toy cash register without sacrificing any desirable features which simulate a full scale cash register, the present invention has been developed to minimize cost while providing a sturdy construction and ease of assembly, details of which are set forth hereinafter.

SUMMARY OF THE INVENTION

It is the primary object of the present invention to manufacture, as far as feasible, all components of a toy cash register by molding the same from rigid plastic materials, one of the outstanding features of which comprises the designing of a shell-like housing which is bipartite and provided with an upstanding rear portion and a forwardly and downwardly sloping upper surface portion extending forwardly therefrom and disposed over a lower compartment in which a cash drawer is slidably movable into and from a front opening in said lower compartment, said housing having a removable rear or back wall and both said back wall and upstanding rear portion of the forward portion of said housing having openings therein through which imitation sale recordings are displayed on a rotatable drum, actuated by a unitary cash key-simulating member which is depressible within a complementary opening formed in the shell of said housing in the forwardly and downwardly sloping upper surface portion thereof, actuation of said cash key simulating member effecting rotation of said drum which has appropriate indicia thereon.

Another object of the invention is to provide a manually operable release key movably supported by the housing adjacent one side thereof and operable to disengage a latch means for the drawer in the lower compartment of the housing to permit the drawer to be moved open by means of a compressible spring and, simultaneously, a receipt-simulating member in the form of a slide is movable forwardly through a slot at one side of said cash key simulating member, movement of said slide being effected by corresponding movement of the drawer, either to open or closed positions, and similarly moving said slide.

A further object of the invention is to actuate said rotatable register drum by means of a finger extending from said cash key-simulating member upwardly and rearwardly toward said drum and engaging lug means on one end of said drum disposed circumferentially around the axis thereof and operable to move said drum uni-directionally when said cash key simulating member is depressed, the preferred embodiment of the invention including pivotal means for said member adjacent the lower end thereof and spring means restoring the member to its initial position after actuation thereof to record a simulated sale.

Still another object of the invention is to form said unitary cash key-simulating member to have a generally rectangular area comprising a plurality of fixed, simulated cash keys upstanding therefrom in a bank arrangement and said entire member being depressed when any individual simulated key thereon is pushed downwardly.

One further object of the invention is to provide latch means for said drawer which are connected to the latch key pivotally mounted at one side of said housing, said latch engaging a locking lug extending from one side of the rearward portion of the drawer and spring means being included upon said latch to restore the same to initial latching position following the depression of said release key, said latch also having a cam surface thereon engageable by said lug on said drawer when the drawer is restored to closed position and effect coengagement between said latch and lug.

Ancillary to the foregoing object, it is another object to provide said simulated cash receipt slide with a projection having a notch therein engageable with an upstanding member on the rearward portion of said drawer whereby said drawer and slide move in forward and rearward movement simultaneously.

One very important further object of the invention is to design said forward portion of said housing in such manner that it is readily moldable to provide on the interior thereof, various ribs to position and quide certain of the movable members within the cash register and also form notch-like recesses in inner sidewalls of said forward portion of the housing respectively to receive pivotal members on opposite ends of the rotatable register drum and respectively receive opposite ends of a shaft extending horizontally within the housing adjacent the lower end of the rectangular opening therein through which the unitary cash key-simulating member is disposed for purposes of pivotally engaging the lower forward end of said member and support the same for limited pivotal movement.

Still another object of the invention is to rotate said register drum by means of a finger projecting from said cash keysimulating member rearwardly and upwardly and the terminal end of said finger being claw-like successively to engage circumferentially spaced lugs extending about the axis of said register drum and operable to advance the same one set of indicia incident to each depressing movement of said cash key simulating member.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

Figure 1:
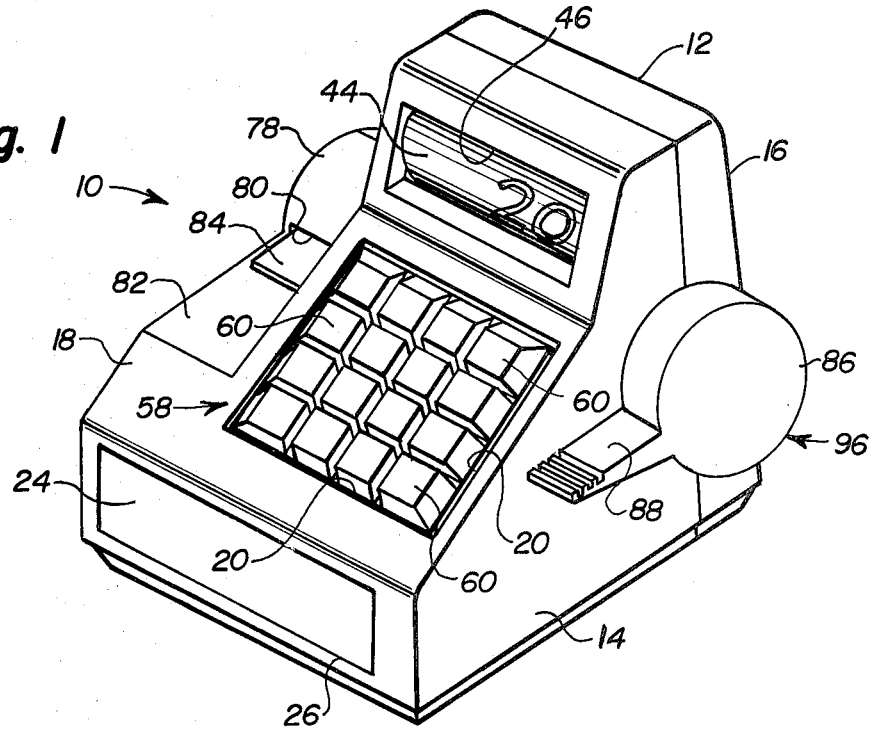
FIG. 1 is a perspective view of a toy cash register embodying the principles of the present invention.

Referring to FIG. 1, the toy cash register embodying the present invention comprises a shell-like housing 10 which preferably is formed by molding the same from rigid plastic material comprising synthetic resin, said housing comprising an upstanding rear hollow portion 12. Said housing also preferably is at least bipartite and is composed of a forward shell-like portion 14 and a rear wall portion 16. The forward portion 14 has a forwardly and downwardly sloping upper surface section 18, which is provided with a relatively large rectangular opening 20.

Figure 3:
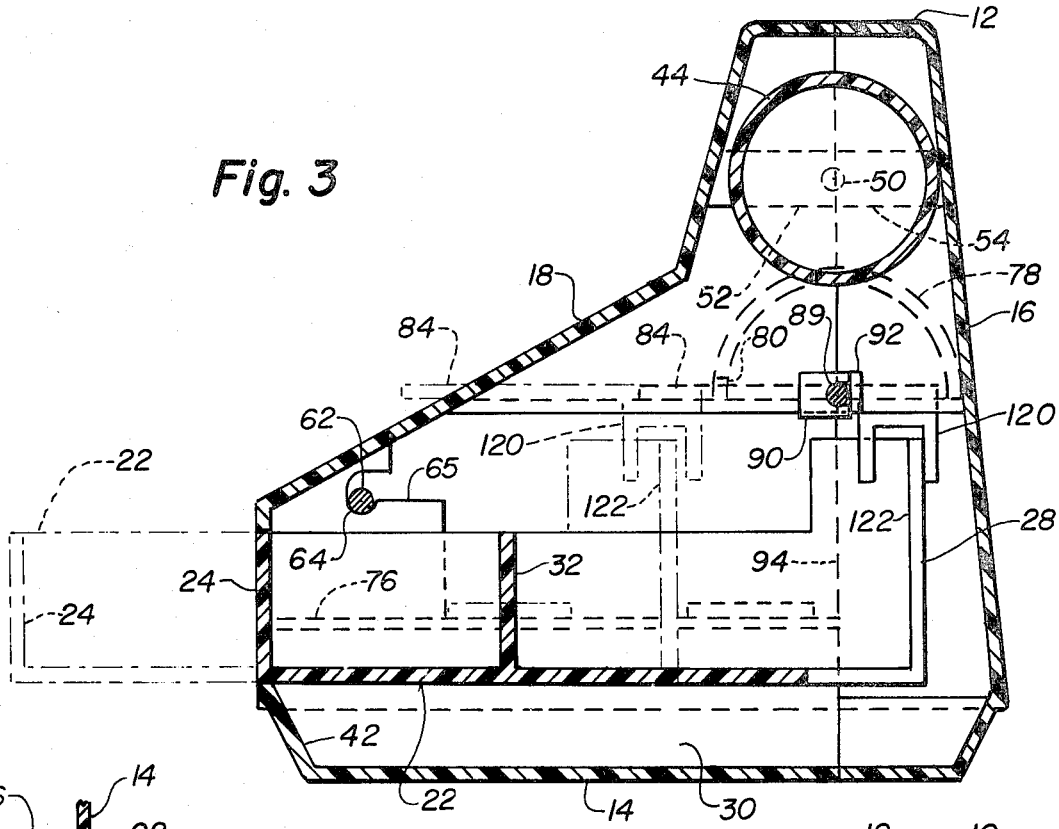
FIG. 3 is a vertical section of the toy cash register shown in FIG. 2, as seen on the line 3—3 thereof.
Figure 4:
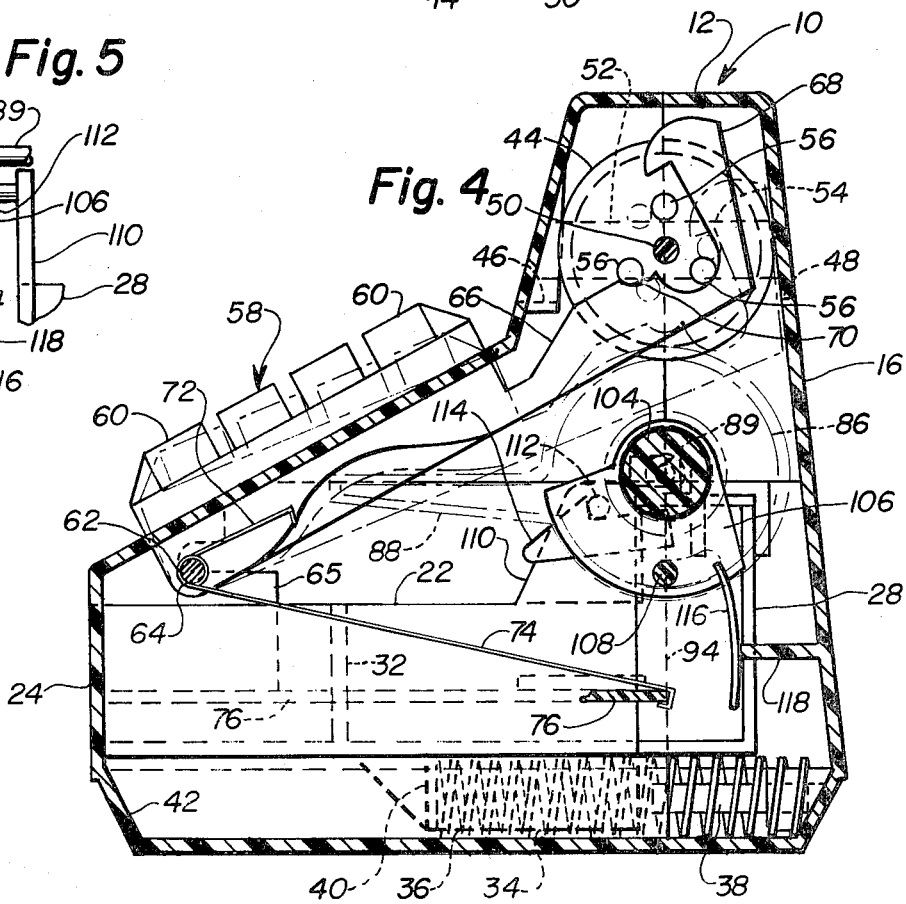
FIG. 4 is another vertical section of the toy cash register shown in FIG. 2, as seen on the line 4—4 thereof.

The lower portion of the housing 10 is hollow and accommodates in slidable manner a cash drawer 22 which has a front wall 24 disposed in a complementary opening 26 in the lower front face of the forward shell portion 14. The inner or rear wall 28 of the drawer 22 projects upwardly above the upper edge of the main portion of the drawer, as best shown in FIGS. 3 and 4, for purposes to be described. Also, the forward shell portion 14 is provided with a plurality of supporting and guide ribs 30 which extend from the front toward the rear end of the forward shell portion for purposes of supporting the drawer 22 which slidably engages the upper surfaces of said ribs, one of which is shown in FIG. 3. The simulated cash-receiving portion of the drawer 22 is in the forward portion thereof and is defined by an intermediate rib 32.

Figure 2:
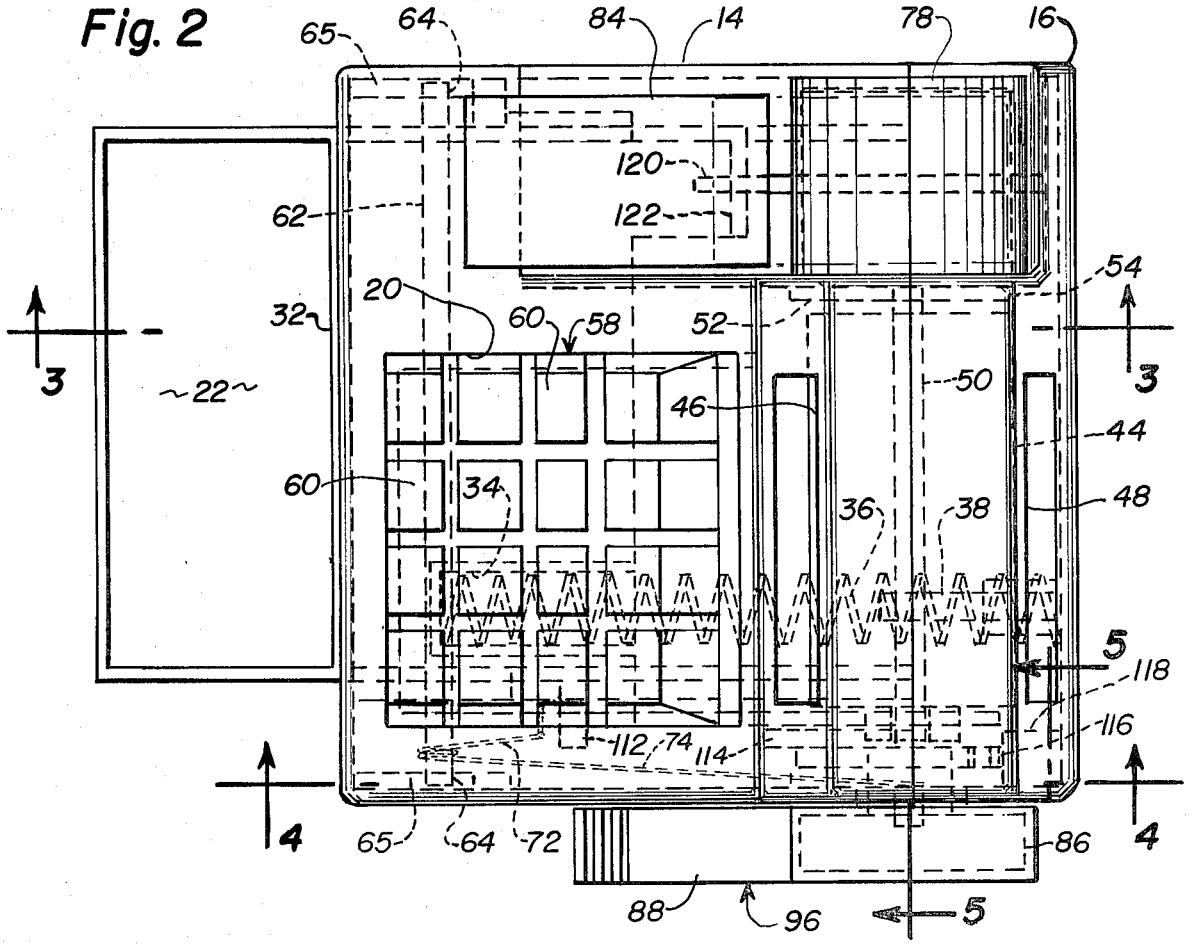
FIG. 2 is a top plan view of the cash register shown in FIG. 1 with the cash drawer extended and certain details on the interior of the housing being shown in phantom.

As best shown in FIGS. 2 and 4, the lower surface of the bottom of the drawer 22 is provided between a pair of parallel ribs with an elongated recess 34 within which one end portion of a compression spring 36 is positioned, the opposite end of said spring extending rearward and encircling a positioning lug 38, which accurately retains the spring in operative position as readily can be visualized especially from FIG. 4. Also, the bottom of the drawer is provided with a downwardly extending stop member 40 which is engageable with the inner surface 42 in the lower portion of the forward shell portion 14 to limit the outwardly projecting movement of the drawer which is illustrated in plan view in FIGS. 2 and in phantom in FIG. 3.

Rotatably supported within the upstanding rear hollow portion 12 of the bipartite housing 10 is a register drum 44, which preferably is hollow and is provided on the outer surface thereof with cash-simulating indicia which are viewable through a front opening 46 formed in the front wall of the upper portion on the forward shell portion 14 as clearly shown in FIG. 1. Also as indicated best in FIG. 4, the corresponding wall portion of the rear wall portion 16 is provided with a similar rear viewing opening 48 by which a "customer", for example, may view the indicia when standing adjacent the rear wall portion 16 of the cash register.

The drum 44, as well as all of the other components of the toy cash register, with the exception of a few metallic members indicated hereinafter, are formed from suitable rigid plastic material by molding the same and thereby, minimize the production cost, as well as facilitate the assembly of the components into a completed toy cash register. Said drum is supported by a suitable shaft 50 which may comprise a metal rod, the shaft extending through opposite end walls of the drum 44 and the opposite ends are received within complementary semicircular notches respectively formed in the abutting ends of transversely disposed flat ribs 52 which are integrally molded against the inner surfaces of the opposite side walls of the upstanding rear portion 12 of housing 10. As best shown in FIG. 4, one end of the drum 44 is provided with a circular pattern of lugs 56 which are evenly spaced in circumferential manner about the shaft 50 to form part of the advancing means for the drum 44.

A unitary cash key-simulating memeber 58 which, as best shown in FIGS. 1 and 2, is substantially square or rectangular and also is molded in unitary fashion from rigid plastic material, and is movably disposed within the rectangular opening 20 and is movable preferably pivotally, between the outermost full line position shown in FIG. 4, and a downwardly or inwardly depressed position, one such position being shown in phantom in FIG. 4. The cash key-simulating member 58 is formed with a plurality of similar projections 60 which represent individual keys and simulate the same in conventional modern type cash registers, but for purposes of simplicity, all the projections 60 are integral on the member 58, whereby when any individual projection is depressed by anyone operating the cash register, the entire group move as indicated in FIG. 4. To pivotally support the cash key-simulating member 58, a rod or shaft 62 extends between suitable holes in parallel sidewalls of the member 58 and projects therebeyond for reception within appropriate seats 64 formed in flat projections 65, see FIGS. 2 and 4, formed on the inner surfaces of opposite sidewalls of the forward shell portion 14. Accordingly, the lower forward end portion of the member 58 is movable about the fixed pivot formed by rod or shaft 62.

On the upper end of the member 58 is a narrow flat finger 66 integrally molded thereto and terminates in an outer claw or hook 68, best shown in FIG. 4, for purposes of sequentially engaging one of the lugs 56, when the cash key-simulating member 58 is depressed to move the same pivotally about the supporting shaft 62. It can readily be visualized from FIG. 4 that when such depression movement occurs, the hook-like claw 68 will engage the nearest lug 56 and rotate the drum 44 for a partial revolution. The finger 66 also is provided with an additional surface 70 which, when the member 58 is released following the depression thereof and the same is moved upwardly to restore the same to initial position by means of the spring wire 72, which is anchored upon the shaft 62, the additional surface 70 on the finger 66 will engage one of the lugs 56 to rotate the drum 44 for another partial revolution by advancing it from the phantom position of the lug shown in FIG. 4, adjacent surface 70, whereby the depression and restoration movement of the fingers 60 will result in two partial revolutions of the drum 44 and constitute a combination of two partial rotatable movements adequate to advance the indicia from one set thereof to another.

Note that spring wire 72 extends around the shaft 62 and the end opposite that which engages the member 58 is an elongated portion 74, see FIG. 4, which engages around a transverse rib 76 to secure the spring in operative position within one side portion of the interior of the housing 10. The rib 76 is partially shown in section in FIG. 4 but it is to be understood that said rib extends longitudinally inwardly from one sidewall of the fromt portion of the housing 10 and the opposite sidewall has a similar rib, the inner surfaces of said rib slidably engaging opposite sides of the drawer 22 to accurately guide the movement thereof within the compartment therefor in the lower portion of the housing 10.

As viewed in FIG. 1, the left-hand side of the cash register is provided with an arcuate side shell 78 which simulates a sales slip discharging unit in an actual full-scale cash register, the forward portion of said shell 78 having a slot 80 therein adjacent a substantially flat horizontal surface 82, formed at one side of the forwardly and downwardly sloping upper surface 18 of the forward shell portion 14, the surface 82 supporting a simulated sales slip 84, which may have suitable indicia thereon indicating a fictitious sale. The simulated sales slip 84 preferably is flat and molded from rigid plastic material, the projection and retraction thereof being effected by the following mechanism.

Figure 5:
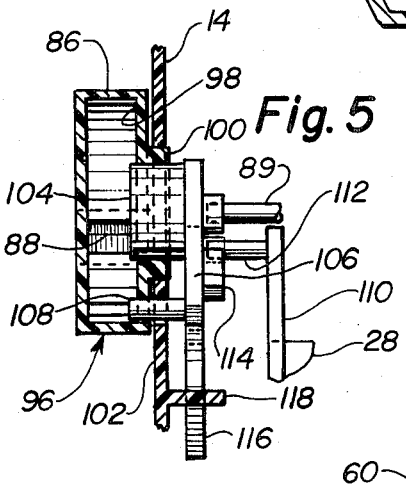
FIG. 5 is a vertical section of details of the cash register shown in FIG. 2, as seen on the line 5—5 thereof.

The side of the cash register opposite that which has the arcuate side shell 78 thereon supports for limited rotation, a release key which comprises a circular head 86 from which a manually-engagable actuating finger 88 extends radially. The circular head 86 is interconnected to one end of shaft 89, which is parallel to and is substantially below the shaft 50 in the upper portion of the housing 10. Such shaft is supported at its ends respectively by notches formed in the inner ends of flat projections 90, see FIG. 3, respectively formed on inner surfaces of opposite sidewalls of forward shell portion 14 of the housing 10, the open ends of said notches each abutting a flat lug 92 formed integrally on the inner surfaces of the narrow sidewalls formed on the rear wall portion 16, which is actually somewhat in the shape of a shell-like configuration, as can be visualized best from FIG. 3, the edges of said shell meeting the corresponding edges of the front portion 14 of housing 10 along the dotted line 94, shown in FIGS. 3 and 4. The circular head 86 and the radially-extending finger 88 thereon comprises a release key 96 which controls the position of the drawer 22, particularly to release the same from closed position in order to permit the spring 36 to project the drawer to the open position shown in full lines in FIG. 2, and in phantom in FIG. 3. The release key 96 actually is composite and comprises details shown best in FIG. 5 but certain of the same also being illustrated in FIG. 4. Referring to FIG. 5, the circular head 86 is hollow and the inner face 98 is provided with a coaxial circular flange 100, which extends through a complementary opening in the sidewall 102 of the forward shell portion 14, as illustrated fragmentarily in FIG. 5, whereby the circular head 86 is rotatable relative to the axis of shaft 89. Associated with and interconnected to circular head 86 is a short circular hug 104, which is coaxial with and extends through the circular flange 100. A segmentally-shaped flange 106 is integrally fixed to one face of the hub 104, the outer edge of the flange 106 being arcuate, as clearly shown in FIG. 4, and said flange has a perpendicular pin 108 fixed to and projecting outwardly therefrom, the outer end of which extends through a complementary hole formed in inner face 98 of circular head 86, as best shown in FIG. 5, whereby the circular head 86 and flange 106 are securely interconnected for pivotal movement as a unit about the axis of shaft 89.

In FIG. 5, a small fragmentary portion of the rear wall 28 of drawer 22, is illustrated to show an upstanding ear 110, a side view of which is shown in FIG. 4, said ear supporting one end of a latching pin 112, which projects perpendicularly to the plane of the ear 110, as shown in FIG. 5. Fixed to the inner face of the flange 106 is cam-type latch member 114, shown in side view in FIG. 4 and in end view in FIG. 5, the outer end of the latching pin 112 engaging the cam-type latch member 114, as shown in FIG. 4, to secure the drawer 22 in closed position, as shown in full lines in FIGS. 3 and 4.

When it is desired to open the drawer 22, the finger 88 is depressed to move the combined circular head 86, hub 104, flange 106, and the integrally-connected latch member 114 thereon in counterclockwise direction, as viewed in FIG. 4, relative to the axis of shaft 89. Such movement will disengage the latching detent of latch member 114 from the outer end of pin 112 and thereby permit the spring 36 to project the drawer forwardly until the stop 40 engages the inner surface 42 of the lower portion of the forward shell portion 14, and thereby limit the projecting movement of the drawer. Such movement of the release key 96 and the above-described elements connected thereto occurs against the action of leaf spring 116, shown in side view in FIG. 4, and in end view in FIG. 5, the upper end of said spring being securely fixed, such as by a slot, in flange 106, and the lower portion thereof bears against a lateral flange 118, molded integrally with andextending inwardly from the inner surface of the rear wall portion 16 of housing 10, said flange also being secured to the sidewall 102 of the housing, as shown in FIG. 5. Upon release of the release key 96, the spring 116 restores the release key 96 and the elements connected thereto to the starting or latching position thereof, as shown in FIG. 4, and meanwhile the drawer 22, is in open position. When the drawer is manually pushed to closed position, the outer end of the latching pin 112 will engage the cam face of latch member 114 and move the same counterclockwise against the action of spring 116 until the pin 112 is moved clear of the latching projection on latch member 114, whereupon the spring 116 restores the latch member 114 to latching position by moving the same clockwise.

Simulated sales slip 84 is shown in retracted position in FIG. 3 in dotted lines, and in phantom, the same is shown in projected position in said figure. Also, in FIG. 1, the same is shown partially projected relative to the horizontal surface 82 which supports the same slidably. Movement of the simulated sales slip 84 is effected by notched depending detent 120, shown in full lines in side view in FIG. 3, wherein the notch formed therein received the upper edge of a vertical projection 122, which extends upwardly from the inner rear wall 28 of drawer 22, the projection 122 also being shown in plan view in FIG. 2.

From the foregoing, the relatively realistic minature cash register comprising a toy is provided by the present invention and includes operating elements, such as the cash keysimulating member 58, which is depressed in realistic manner to rotate the register drum 44 to show an exemplary single or group of indicia on the drum 44 to show visually a sales amount which is viewable either from the front or rear of the upstanding rear hollow portion 12 of housing 10 through the front opening 46 and the rear viewing opening 48. Following this, as in the operation of full-scale cash registers, the next step is to gain access to the cash drawer 22, whereupon the finger 88 of the release key assembly 96 is depressed to release the latch member 114 from the latching pin 112 on the rear portion of the drawer 22, whereupon the compression spring 36 is free to project the drawer 22 to the extended open position, shown in full lines in FIG. 2, and in phantom in FIG. 3. Rotation of the cash register drum 44 also is stepwise and due to the particular operation of the finger 66 that extends from the cash key-simulating member 58 for successive engagement of the claw 68 and additional surface 70 thereon sequentially with certain of the lugs 56, projecting from one end of the drum 44. The simulated projection of a cash slip 84 also occurs when the drawer 22 is moved to open position, and if desired, the simulated sales slip 84 may be removed from the cash register simply by lifting it from the surface 82 and disengaging the notched detent 120 from the projection 122 on the rear portion of the drawer 22. It is conceivable that detent 120 could be in the form of an ear extending from one edge of the simulated sales slip 84, which, if made of suitable stiff material susceptible to bending, a stack of such slips can be furnished with the cash register and individually placed in operative manner within the cash register each time the same is operated simply by bending the detent perpendicularly downward from one edge of the simulated sales slip 84.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy cash register comprising in combination, a shell-like housing provided with an upstanding rear hollow portion and a forwardly and downwardly sloping upper surface section extending forwardly therefrom and positioned over a lower compartment, said sloping surface having a relatively large opening therein, a cash drawer slidable into and from a front opening in said lower compartment, latch means normally engaging complementary retaining means on said drawer within said compartment and spring means in said housing engaging said drawer to project it forwardly from said compartment when said latch is released, a rotatable register drum having money indicating indicia thereon enclosed within said upstanding rear hollow portion of said housing and operable about a horizontal axis therein, viewing means in a forward face of said upstanding rear portion of said housing within which indicia on said drum are viewable, a unitary cash key-simulating member having an area similar in size to said opening in said sloping surface and comprising a plurality of simulated cash keys upstanding thereon in fixed relation to each other in a bank arrangement and actuating means thereon extending from one end of said member into said upstanding portion of said housing and engageable with said rotatable register drum to rotate it, means pivotally connecting the opposite end of said key-simulating member to said housing for actuation thereof by depressing said member downwardly to effect rotation of said register drum, a release key pivotally supported by said housing and including means engageable with said latch means to disengage the same from said drawer and permit said spring means to project it to open position, and receipt-simulating member slidable forwardly through an opening in said housing upon actuation of said release key.

2. The toy cash register according to claim 1 in which said actuating means on said cash key-simulating member for engagement with said rotatable register drum comprises a finger extending from said one end of said member and engages lug means on one end of said drum for unidirectional rotation of said drum when said cash key-simulating member is depressed.

3. The toy cash register according to claim 2 in which said cash key-simulating member is pivotally connected to said housing adjacent the lower forward end of said member and said finger on said member extends rearwardly and upwardly from said one end of said member for engagement sequentially with a plurality of lugs extending axially from one end of said drum in circumferentially spaced arrangement around the axis of said drum.

4. The toy cash register according to claim 1 in which said release key is fixedly connected to one end of a relatively straight horizontal shaft pivotally supported within said housing adjacent the rear portion of said compartment for limited rotation and said key being adjacent one exterior side of said housing and having a finger engageable lever thereon positioned laterally and adapted to be depressed downward manually, said latch means also being fixed to said shaft and engageable with said complementary retaining means on said drawer positioned upon one side thereof, spring means on said latch operable to restore it to latching position after depression of said key to move said latch to releasing position, and said latch having cam means engageable by said retaining means on said drawer when said drawer is returned to enclosed position within said compartment therefor in said housing.

5. The toy cash register according to claim 1 in which said receipt-simulating member comprises a slide supported by said housing for movement through a slot in said housing adjacent one side of said cash key-simulating member, and coengageable means on said drawer and slide operable to project said slide forwardly from said housing for viewing when said drawer slides open and said slide is retracted by said drawer when it is pushed inwardly to closed position within said compartment in said housing.

6. The toy cash register according to claim 1 in which said housing is molded from rigid material and is rendered bipartite by the rear wall thereof being separably connected to the forward portion of said housing, said rear wall having an opening in the upper portion thereof adjacent said register drum through which indicia on said drum are viewable, said forward portion of said housing having guide ribs adjacent opposite interior sides of the lower portion thereof to guide movement of said drawer therebetween and also having a substantially horizontal surface on the interior of the forward portion of said housing adjacent a slot aligned therewith complementary in size to said receipt-simulating member and comprising said opening therefor and said receipt-simulating member comprising a slide supported slidably by said horizontal surface and projectable through said slot when said drawer is moved to open position.

7. The toy cash register according to claim 6 in which said forward portion of said housing in the upstanding rearward portion thereof has recesses horizontally aligned in the inner side walls of said portions and said register drum having axial means on opposite ends respectively received within said recesses to support said drum rotatably, said forward portion of said housing also having additional recesses in opposite interior sides thereof adjacent the lower edge of said cash key-simulating member and receiving opposite ends of a horizontal shaft engaging the lower edge portion of said member to pivotally support the same, and said sloping upper surface of said forward portion of said housing having a generally rectangular opening complementary in shape to said cash key-simulating member within which said member is positioned for limited pivoted depressing movement about said shaft to actuate said rotatable register drum.

8. The toy cash register according to claim 6 in which said drawer has an upstanding member on the inner end thereof and said receipt-simulating slide has a depending actuating member provided with a notch to receive said upstanding member on said drawer to interconnect the same for actuation.

9. The toy cash register according to claim 6 in which said drawer is molded from rigid material and is provided with an elongated recess on the bottom lower surface thereof, a lug formed on the interior of said rear wall of said housing in axial alignment with said recess, said spring means comprising a coiled compression spring mounted in said recess and one end thereof engaging said lug to position the same, and stop means on the bottom of said drawer engaging complementary means of said forward portion of said housing to limit opening movement of said drawer.

10. The toy cash register according to claim 1 in which said actuating means on said cash key-simulating member comprises a finger extending upwardly from one side of the inner end of said member and having a claw-like end, and said register drum having a circular pattern of a plurality of evenly spaced lugs projecting outwardly from one end thereof in position to be engaged successively by said claw-like end of said finger each time said key-simulating member is depressed to partially advance said drum, and said finger also having an addditonal surface positioned to engage one of said lugs when said key-simulating member is moved upwardly to its uppermost position and thereby further advance said drum rotatably in the same direction as the movement effected by said claw-like end of said finger to complete a desired extent of rotatable advancement of said drum corresponding to each complete movement of said key-simulating member in depressed and upward movements thereof.

* * * * *